US006119488A

United States Patent [19]

Dawn

[11] Patent Number: 6,119,488

[45] Date of Patent: Sep. 19, 2000

[54] PISTON ASSEMBLY DRIVE FOR KNITTING MACHINE ACTUATING SINKERS

[75] Inventor: Terry Dawn, Nottingham, United Kingdom

[73] Assignee: The RHD Company Limited, United Kingdom

[21] Appl. No.: 09/125,637

[22] PCT Filed: Feb. 24, 1997

[86] PCT No.: PCT/GB97/00501

§ 371 Date: Nov. 9, 1998

§ 102(e) Date: Nov. 9, 1998

[87] PCT Pub. No.: WO97/31144

PCT Pub. Date: Aug. 28, 1997

[30] Foreign Application Priority Data

Feb. 24, 1996 [GB] United Kingdom ..... 9603941

[51] Int. Cl.[7] ..... D04B 15/06; D04B 15/26

[52] U.S. Cl. ..... 66/110; 66/217; 66/107

[58] Field of Search ..... 66/107, 108 R, 66/110, 217

[56] References Cited

U.S. PATENT DOCUMENTS 4,191,222 3/1980 Marshall ..... 139/453
4,298,034 11/1981 Viscardi ..... 139/453
5,184,483 2/1993 Conti ..... 66/93
5,494,080 2/1996 Sano ..... 139/93

FOREIGN PATENT DOCUMENTS 0026425 9/1980 European Pat. Off. .
0602383 11/1993 European Pat. Off. .
2951386 7/1980 Germany .
2174414 11/1986 United Kingdom .

*Primary Examiner*—Andy Falik
*Attorney, Agent, or Firm*—Cahill, Sutton & Thomas P.L.C.

[57] ABSTRACT

An elongate support body includes each of a plurality of pistons longitudinally translatable to urge movement of a corresponding sinker in a straight bar knitting machine. A piston chamber is disposed within or attached to the support body and includes a translatable piston head disposed therewithin. Each of a plurality of piston cylinders housing the respective ones of the plurality of pistons is in fluid communication with the piston chamber. Upon introduction of a fluid under pressure into the piston chamber on one side of the piston head, fluid pressure will be introduced serially into each piston cylinder to actuate each piston as the piston head translates along the piston chamber.

15 Claims, 4 Drawing Sheets

PISTON ASSEMBLY DRIVE FOR KNITTING MACHINE ACTUATING SINKERS

CROSS REFERENCE TO RELATED APPLICATION

The present application is an application filed under the National Phase of and claims priority to PCT application entitled "Sinker Drive Mechanism" assigned Ser. No. GB97/00501 and filed Feb. 24, 1997, which PCT application claims priority to a patent application filed in Great Britain entitled "Sinker Drive Mechanism", assigned Ser. No. 96-03941.7 and filed Feb. 24, 1996, each of which describe inventions made by the present inventor and assigned to the present assignee.

BACKGROUND OF THE INVENTION

1. Field of the Invention

The present invention relates to a sinker drive mechanism, in particular but not exclusively for driving sinkers in a straight bar knitting machine.

2. Description of Related Art

In a straight bar knitting machine, sinkers are advanced after having received yarn in order to draw the yarn around the needle shanks prior to operation of the needles.

Conventionally, each sinker is advanced mechanically by a striking jack which is engaged by a slur cock which traverse across the back of the sinkers so as to advance each sinker in succession.

The mechanical action of a slur cock is noisy, relatively slow and requires continuous maintenance.

SUMMARY OF THE INVENTION

The sinker drive mechanism for a knitting machine includes a piston assembly for actuating the sinkers. The mechanism has valve means for advancing in succession each of a plurality of pistons of the piston assembly and disposed along the length of a support body to actuate the respective sinker. The valve means includes a piston head movable along a piston chamber within the support body to introduce pressure to each piston of the plurality of pistons and urge serial movement of the plurality of pistons with resulting actuation of the respective sinkers.

It is therefore a primary object of the present invention to provide an improved drive mechanism which overcomes drawbacks associated with conventional mechanical sinker drive mechanisms.

According to one aspect of the present invention there is provided a sinker drive mechanism including an elongate support body including a plurality of pistons spaced along its length, each piston being extendable to advance an individual sinker to an extended position.

According to another aspect of the present invention there is provided a knitting machine or weaving machine including a drive mechanism as defined above.

BRIEF DESCRIPTION OF THE DRAWINGS

Reference is now made to the accompanying drawings, in which.

DETAILED DESCRIPTION OF THE INVENTION

Figure 1:
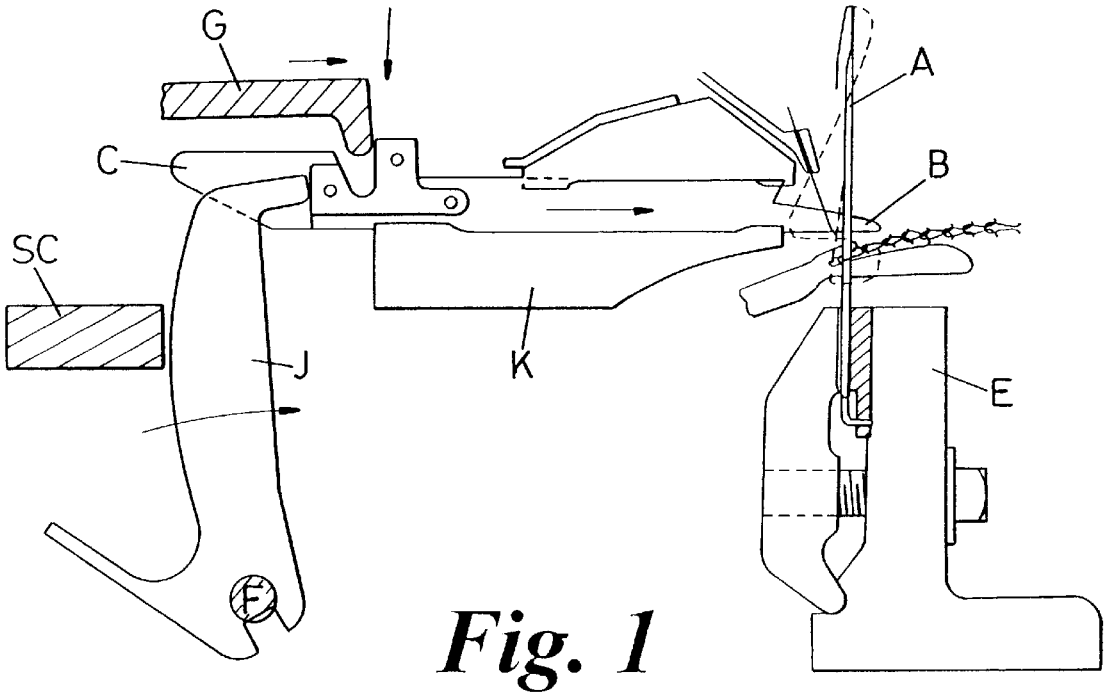
FIG. 1 is a cross-sectional view through the knitting head of a conventional straight bar knitting machine.
Figure 2:
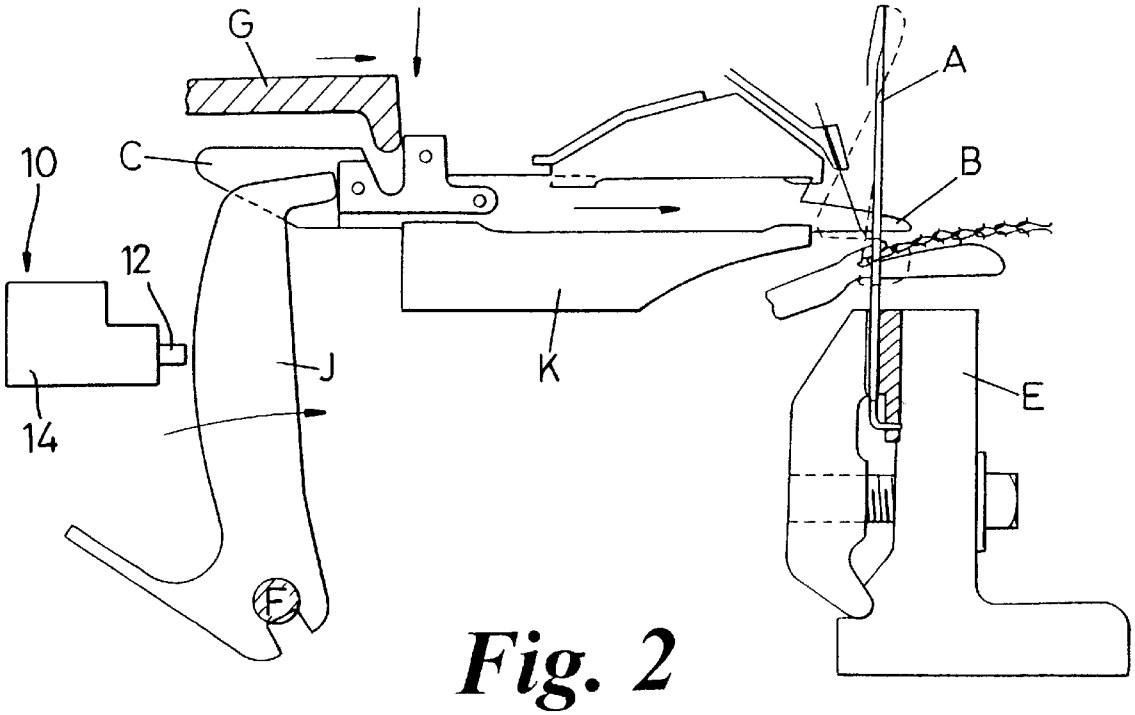
FIG. 2 is a similar view to FIG. 1 showing a straight bar knitting machine modified in accordance with a first embodiment of the present invention.

Referring initially to FIG. 1 there is shown a typical layout of a conventional straight bar knitting machine having knitting needles A held in a needle bar E. Sinkers B (typically one between every two needles) are slidingly received in a sinker bar K which extends along the length of the knitting head. Dividers C are usually located inbetween each pair of neighbouring sinkers.

A catch bar G extending along the length of the knitting head is provided for advancement of the dividers and the simultaneous retraction of the sinkers and dividers.

A slur cock SC is provided mounted on a guide rail extending along the knitting head. The slur cock SC moves along the guide rail and advances each sinker sequentially by engaging by a camming action, an associated striking jack J.

In accordance with a first embodiment of the present invention (FIG. 3), the slur cock SC and associated guide rail and drive mechanism is replaced by a sinker drive mechanism 10 which operates the sinkers via the striking jacks J. In accordance with a second embodiment of the present invention (FIG. 9), the striking jacks J are also replaced so that the sinker drive mechanism operates directly upon the sinkers B. In both embodiments the drive mechanism 10 basically comprises a series of independently movable striking pistons 12 housed in a support body 14 which extends along the length of the knitting head, there being one striking piston 12 for striking each jack J. The body 14 is conveniently mounted upon the machine bed which normally supports the conventional slur cock rail.

The pistons 12 are operated in sequence along the length of the support body 14 so as to operate the striking jacks J sequentially along the knitting head; retraction of the pistons 12 being achieved by the conventional motion of the catch bar G when retracting the sinkers B and dividers C.

Figure 3:
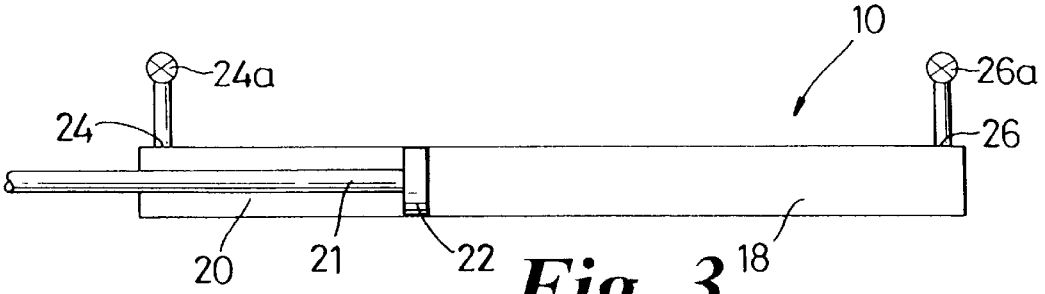
FIG. 3 is a diagrammatic sectional view of a sinker drive mechanism according to the present invention.
Figure 4:
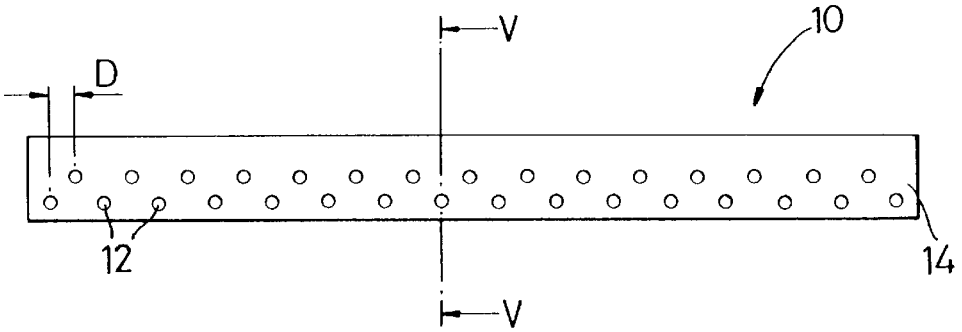
FIG. 4 is a front view of the drive mechanism shown in FIG. 3.
Figure 5:
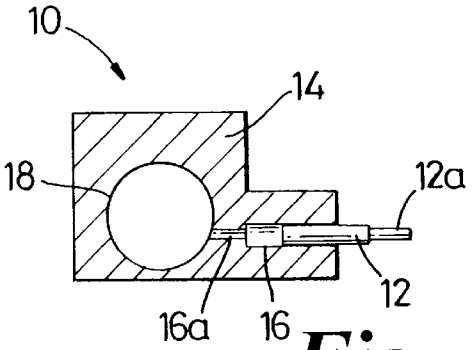
FIG. 5 is a cross-sectional view taken along line V—V in FIG. 4.

In the embodiment shown in FIGS. 3 to 5, the body 14 is conveniently made from a machinable material such as a suitable metal, eg brass and the pistons 12 are preferably each in the form of a rod having a close tolerance fit within a cylinder bore 16. Seals between the piston 12 and associated cylinder bore 16 are preferably not provided in order to avoid lubrication, overheating and seizure problems. Instead, the cylinder bore 16 and/or the pistons 12 are coated with a hard wearing low friction material such as polytetrafluoroethylene. A conventional coating process known as the 'Nyflor' process is used in order to attain a coating having a hardness in the range of 800–1000 Vickers. The tolerance between the piston 12 and associated cylinder bore 16 is chosen to give the desired pressure sealing characteristics for advancing the pistons 12 when exposed to pressurised fluid. The tolerance is preferably 0 to 1 thousandth of an inch for a piston 12 of 3/16 inch diameter.

Figure 9:
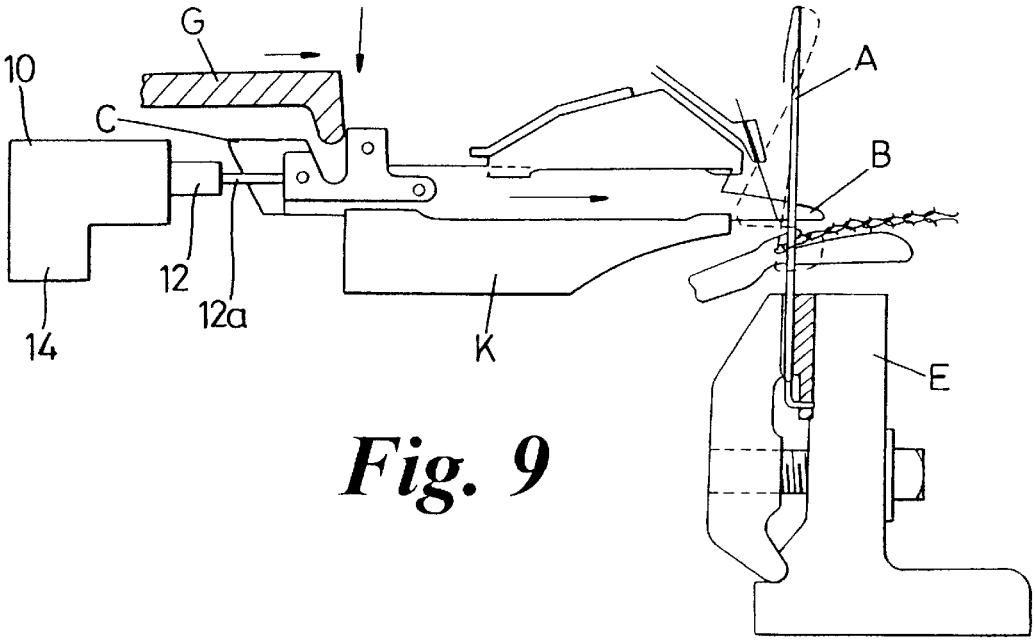
FIG. 9 is a similar view to FIG. 2 showing a straight bar mechanism according to a second embodiment of the present invention.

Preferably as shown in FIGS. 5 and 9, the pistons 12 include a head 12*a* of reduced diameter to enable the piston to extend inbetween adjacent dividers C for operating the sinker B located therebetween.

Sequential advancement of the pistons 12 is preferably achieved as indicated in FIG. 3.

In the embodiment shown in FIG. 4, the support body 14 includes an elongate cylinder bore 18 defining a piston chamber in which a piston 20 is housed. The piston 20 includes a piston stem 21 having a piston head 22. Preferably, the piston head 22 carries one or more piston rings (not shown) made for example from cast iron for providing a seal between the piston head 22 and bore 18.

Preferably the piston 20 is rotatable about its longitudinal axis and indexing means (not shown) are preferably provided for indexing the piston 20 through a small area prior to each stroke of the piston. In this way wear on the piston rings caused by the mouths of bores 16 is evenly distributed about the circumference of the piston rings.

Located at one end of the cylinder bore 18 is a port 24 having a valve 24*a* and located at the opposite end of the cylinder bore 18 is a port 26 having a valve 26*a*. All the cylinder bores 16 communicate with the cylinder bore 18 via conduits 16*a*.

During one knitting cycle, the piston head 22 is driven from one end to the other end of the bore 18. At commencement of the stroke of the head 22, all pistons 12 reside at their retracted positions due to the return motion of the catch bar G during the previous knitting cycle.

Immediately prior to the advancement of piston head 22, the port 24, 26 located at the advancement side of piston head 22 is vented so as to avoid pressure build up on the upstream side of the piston head 22 as it advances and the port 24, 26 located on the downstream side of the piston head 22 is connected to a source of pressurised fluid, typically compressed air. Typically the source of pressurised air is at a pressure of 150 psi; the pressure for advancing each piston being typically 2 psi.

Accordingly, as the piston head 22 advances, it sequentially opens communication between successive cylinder bores 16 and the pressurised fluid on the downstream side of the piston head 22 and so sequentially advances neighbouring pistons 12 as it proceeds toward the upstream end of the cylinder bore 18.

Preferably the size of the conduits 16*a* is chosen such that the conduit opening neighbouring of neighbouring conduits 16*a* are sufficiently spaced from one another in the axial direction of bore 18 such that each piston 12 is fully advanced before the next succeeding piston 12.

Accordingly, the piston 20 effectively acts as a linear valve for sequentially supplying pressurised fluid to successive cylinder bores 16.

After all the pistons 12 have been advanced, cylinder bore 18 is vented to enable the catch bar G to subsequently retract all the pistons 12 during the later stages of the knitting cycle.

Preferably as shown in FIG. 4, the pistons 12 are arranged in laterally spaced rows extending along the length of the body 14, the pistons 12 in each row being staggered to thereby enable a minimum pitch distance D to be achieved. The pitch between the pistons 12 corresponds to the distance between adjacent striker jacks J so that there is one piston 12 per striker jack.

In the event that the knitting machine has sinkers only (ie. the dividers are replaced by sinkers and associated striking jacks) then additional pistons 12 would be provided.

Typically for machines of 21 to 30 gauge, the diameter of the pistons 12 would be about 3/16 inch.

Figure 6:
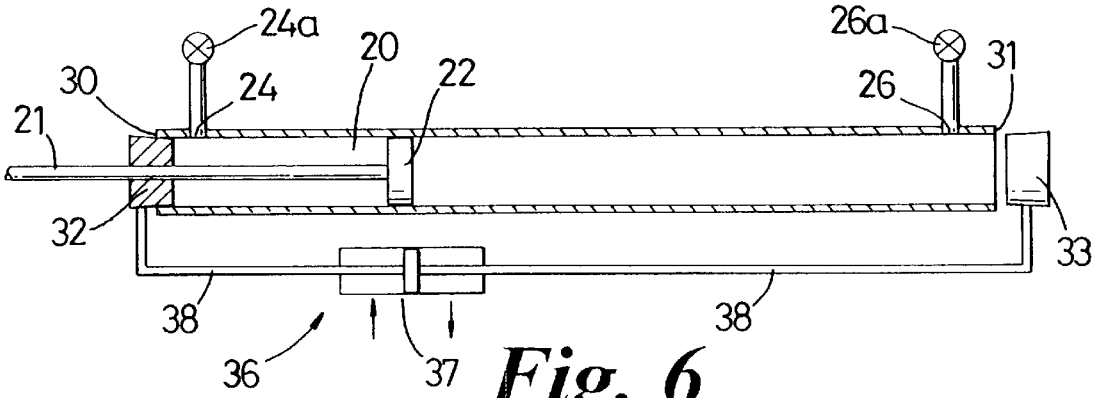
FIG. 6 is a view similar to FIG. 3 of an alternative embodiment.

An alternative arrangement is illustrated in FIG. 6 for controlling supply of pressurised fluid to the cylinder bore 16 and for venting one end of the bore 18 during advancement of the piston head 22.

In FIG. 6 the cylinder bore 18 is open ended at both ends to define large venting ports 30, 31 respectively. In this embodiment, ports 24, 26 serve to supply pressurised fluid only under the control of respective valves 24*a*, 26*a*.

A pair of valve elements 32, 33 are provided for sealingly closing respective ports 30, 32. Preferably as shown, valve elements 32, 33 are connected to a common drive mechanism 36 simultaneously closing and opening of the ports 30, 32. In FIG. 6, the drive mechanism 36 includes a piston and cylinder assembly 37 which through connecting rods 38 move the valve elements 32, 33.

Figure 7:
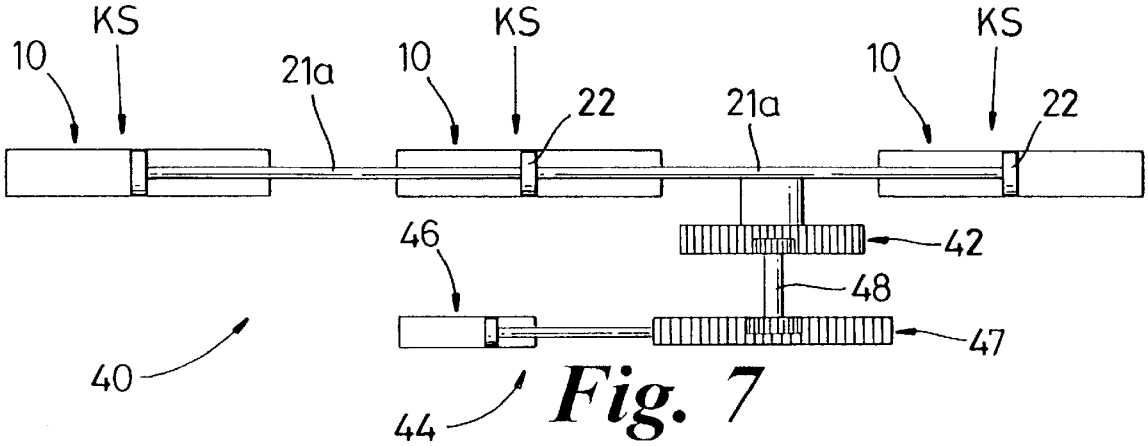
FIG. 7 is a schematic diagram of a multi-sectioned knitting machine.
Figure 8:
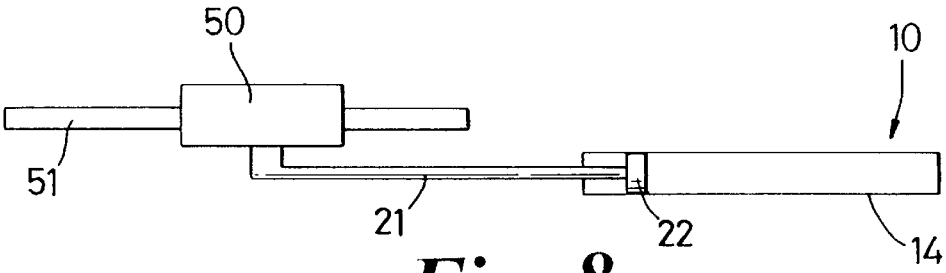
FIG. 8 is a schematic diagram of a single sectioned knitting machine.

Two alternative drive mechanisms are illustrated in FIGS. 7 and 8 for reciprocating the piston 20.

In FIG. 7, a drive mechanism 40 for driving pistons 20 in a multiple section straight bar knitting machine is illustrated. In FIG. 7, 3 knitting sections KS are illustrated in which each section KS includes a sinker drive means 10 according to the present invention. The pistons 20 of each sinker drive means are mechanically connected in series by connecting rods 21*a*.

One of the connecting rods 21*a* is drivingly connected to a toothed rack 42 which is reciprocated by a drive means 44. The drive means 44 preferably comprises a piston and cylinder assembly 46 which is arranged to reciprocate a toothed rack 47; a pinion gear 48 being provided to transmit drive from rack 47 to rack 42. Preferably a reduced gear ratio of about 4:1 is chosen between racks 47 and 42.

Accordingly as assembly 46 reciprocates rack 47, all the pistons 20 are simultaneously reciprocated across their respective knitting sections KS.

Although FIG. 7 only illustrates three knitting section KS, it will be appreciated that the knitting machine may include more or fewer knitting section KS.

In FIG. 8, an alternative drive means for piston 20 is illustrated which is particularly suitable for a knitting machine having a single knitting section. In FIG. 6, the piston rod 21 is connected to a linear motor 50 which is arranged to reciprocate along a rail 51. A suitable linear motor is a microstepping motor, as for example a 'L-series stepping linear motor' as produced by Parker. A stepping linear motor is preferred as it can be controlled to accelerate/decelerate in a desired manner during its reciprocal driving stroke of the piston 20.

As an alternative, it is envisaged that the linear motor may be a continuously operable linear motor controlled by an encoder which responds to displacement of the motor.

Figure 10:
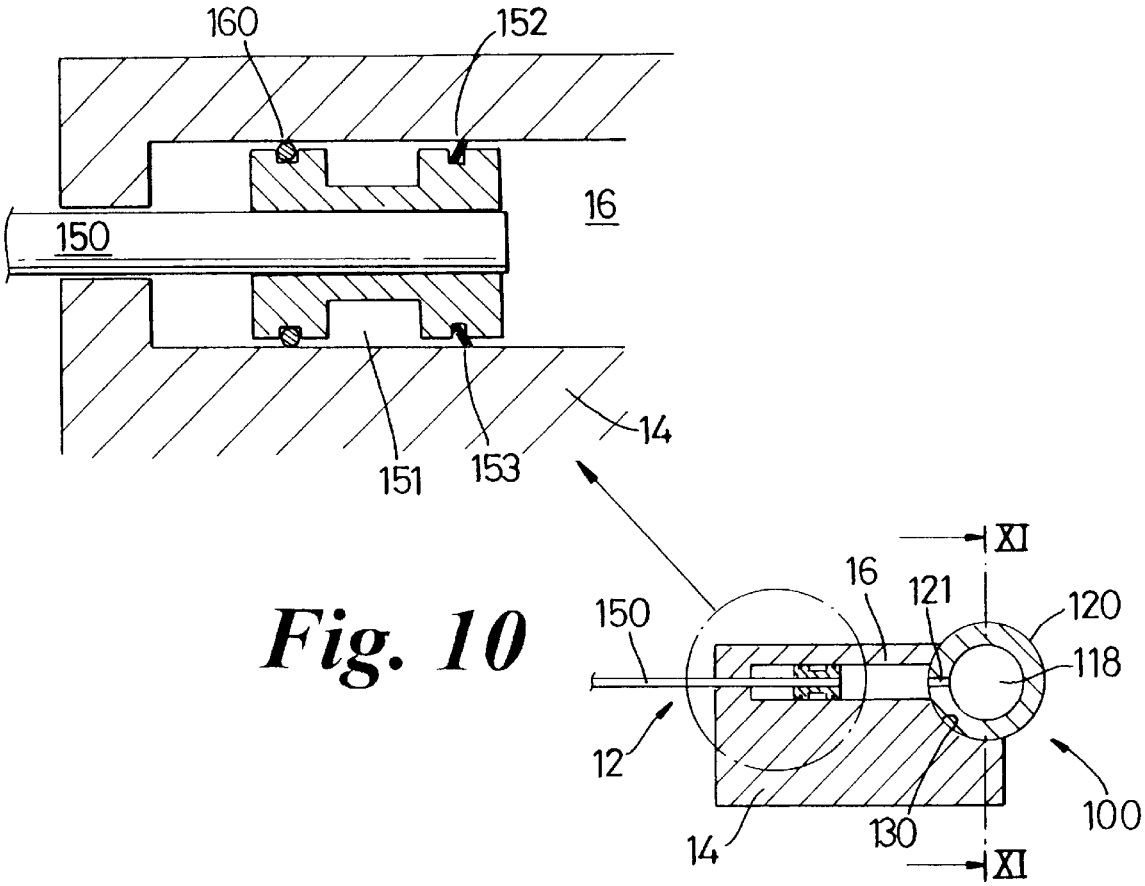
FIG. 10 is a similar view to FIG. 5 showing a modified embodiment according to the present invention.
Figure 11:
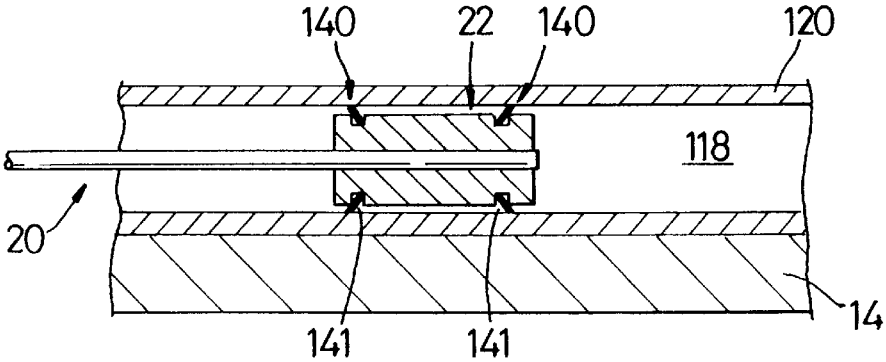
FIG. 11 is a cross-sectional view taken along line XI—XI in FIG. 10.

A modified embodiment 100 is illustrated in FIGS. 10 and 11. In embodiment 100 the piston chamber is defined by the internal bore 118 of a hollow tube 120. The hollow tube 120 is provided with a plurality of communication bores 121 extending generally radially through the wall of the tube 120. The bores 121 are spaced along the length of the tube and are arranged such that each bore 121 is aligned with a corresponding cylinder bore 16 so as to provide fluid communication between the corresponding bore 16 and the piston chamber.

The tube 120 is conveniently made from a suitable plastics material such as a polyamide. Accordingly the tube 120 is simple to manufacture, by for example extrusion techniques to define the piston chamber. Drilling of the tube wall is conveniently performed in order to define the communication bores 121.

The support body 14 in embodiment 100 includes an elongate recess 130 which defines a seat for the tubes 120. The recess 130 is preferably part circular in cross-section having a diameter corresponding to the outer diameter of tube 120.

Terminal ends of the piston cylinders 16 open into the recess 130. Accordingly, when the tube 120 is seated in the recess 130, its outer face is in face to face contact with the recess 130 with bores 121 aligned with corresponding cylinders 16. The tube 120 is preferably secured in the seat by a suitable adhesive which also acts to provide a seal to prevent leakage of fluid between neighbouring cylinders 16. A silicon based adhesive has been found to be suitable.

Preferably in embodiment 100, the piston head 22 is provided with resilient annular seals 140 which sealingly engage the internal face of bore 118. Each seal 140 preferably includes an inclined seal lip 141 which when exposed to fluid pressure is deflected outwardly to increase sealing contact with the internal face of bore 118.

Preferably in embodiment 100, the support body 14 is formed from a suitable plastics material, such as for example a polyamide.

Preferably in embodiment 100, each piston 12 includes a piston stem 150 formed from a small diameter rod, preferably made of steel, and a piston head 151 having a resilient seal 152 for sealingly contacting the internal face of the associated cylinder 16. The seal 152 preferably includes an inclined seal lip 153 which deflects outwardly when exposed to fluid pressure to thereby increase sealing contact with the internal face of the associated cylinder 16.

Preferably a second annular seal 160 is provided on the piston head 151 at a spaced located along the axis of the piston. The second seal 160 may be of any conventional formed. Conveniently the piston head 151 is formed from a suitable plastics material, such as for example a polyamide.

Operation of the embodiment 100 is the same as that described in respect of the previous embodiments.

The above embodiments relate to the use of the sinker drive means according to the invention in a straight bar knitting machine. It will be appreciated that the drive means is adapted to be retrofitted in existing straight bar knitting machines.

It will also be appreciated that the drive means may be incorporated into other types of knitting or weaving machines requiring the sequential extension of a series of component parts.

What is claimed is:

1. A sinker drive mechanism for actuating sinker elements intended to draw yarn around needles prior to operation of the needles, comprising an elongate support body, a plurality of pistons spaced along the length of said support body, and means for extending each piston of said plurality of pistons to advance an individual sinker element to an extended position.

2. A mechanism according to claim 1 including valve means arranged to advance each piston of said plurality of pistons in succession along the length of said support body.

3. A mechanism according to claim 2 wherein said valve means includes a piston head movable along a piston chamber extending along said support body, the piston cylinders of said plurality of pistons being spaced longitudinally along and in fluid communication with said piston chamber.

4. A mechanism according to claim 3 wherein said piston chamber is formed within said support body.

5. A mechanism according to claim 4 wherein said piston head is reciprocally driven along said piston chamber by drive means, vent means being provided at each end of said piston chamber for venting said piston chamber on the downstream side of said piston head during each stroke of reciprocal movement.

6. A mechanism according to claim 5, wherein said vent means is arranged to close or open the respective ends of said piston chamber.

7. A mechanism according to claim 3 wherein said piston chamber is formed within a hollow tubular member secured to aid support body.

8. A mechanism according to claim 7, wherein said piston head is reciprocally driven along said piston chamber by drive means, vent means being provided at each end of said piston chamber for venting said piston chamber on the downstream side of said piston head during each stroke of reciprocal movement.

9. A mechanism according to claim 8, wherein said vent means is arranged to close or open the respective ends of said piston chamber.

10. A mechanism according to claim 7, wherein said hollow tubular member comprises a tube extruded from a plastic material.

11. A mechanism according to claim 10, wherein said piston head is reciprocally driven along said piston chamber by drive means, vent means being provided at each end of said piston chamber for venting said piston chamber on the downstream side of said piston head during each stroke of reciprocal movement.

12. A mechanism according to claim 11, wherein said vent means is arranged to close or open the respective ends of said piston chamber.

13. A mechanism according to any of claims 3 wherein said piston head is reciprocally driven along said piston chamber by drive means, vent means being provided at each end of said piston chamber for venting said piston chamber on the downstream side of said piston head during each stroke of reciprocal movement.

14. A mechanism according to claim 13 wherein said vent means is arranged to close or open the respective ends of said piston chamber.

15. A sinker drive mechanism comprising an elongate support body adapted for extending along a knitting head having a plurality of knitting needles and sinkers spaced along the knitting head, said support body including a plurality of pistons spaced along the length of said support body, means for moving each piston of said plurality of pistons from said support body to an extended position to advance an individual sinker to an extended position for drawing yarn around the needles.

* * * * *